US005653824A

United States Patent [19]

Manning et al.

[11] Patent Number: 5,653,824

[45] Date of Patent: *Aug. 5, 1997

[54] MAGNETIC STRIPS AND METHODS FOR MAKING THE SAME

[75] Inventors: Neil R. Manning; Richard L. Anderson, both of Marengo, Ill.

[73] Assignee: The Arnold Engineering Company, Marengo, Ill.

[ * ] Notice: The term of this patent shall not extend beyond the expiration date of Pat. No. 5,611,872.

[21] Appl. No.: 605,463

[22] Filed: Feb. 26, 1996

Related U.S. Application Data

[60] Division of Ser. No. 394,705, Feb. 27, 1995, Pat. No. 5,527,399, which is a continuation-in-part of Ser. No. 114, 439, Aug. 30, 1993, Pat. No. 5,431,746.

[51] Int. Cl.[6] ..... H01F 1/147

[52] U.S. Cl. ..... 148/306; 148/307; 340/572

[58] Field of Search ..... 148/306, 307; 340/551, 572

[56] References Cited

U.S. PATENT DOCUMENTS

| | | | |
|---|---|---|---|
| 1,773,793 | 8/1930 | Sattler | 148/306 |
| 4,059,462 | 11/1977 | Masumoto et al. | 148/307 |
| 4,145,232 | 3/1979 | Solomon | 148/235 |
| 4,152,177 | 5/1979 | Mantel et al. | 148/235 |
| 4,386,972 | 6/1983 | Knight | 148/235 |
| 4,510,489 | 4/1985 | Anderson, III | 340/572 |
| 5,089,061 | 2/1992 | Abe et al. | 148/110 |
| 5,257,009 | 10/1993 | Narlow | 340/572 |
| 5,278,573 | 1/1994 | Silkaria | 343/749 |
| 5,285,194 | 2/1994 | Ferguson | 340/572 |
| 5,313,192 | 5/1994 | Ho et al. | 340/551 |
| 5,341,125 | 8/1994 | Plonsky et al. | 340/572 |
| 5,351,033 | 9/1994 | Liu et al. | 340/572 |
| 5,357,240 | 10/1994 | Sanford et al. | 340/572 |
| 5,367,289 | 11/1994 | Baro et al. | 340/566 |

OTHER PUBLICATIONS

Alban et al., *Heat Treating*, Metals Handbook Ninth Edition, (1981), 135–137.

Araki, et al., *Dependence of Electric and Magnetic Properties of CVD Carbon Films on Heat Treatment Temperature*, Technology Reports of the Osaka University , vol. 40, No. 2015, (1990), pp. 255–265.

Bozorth, R., *Materials for Permanent Magnets,* Ferromagnetism (1951), pp. 374–378.

Brick et al., *Structure and Properties of Engineering Material*, Fourth Edition (formerly entitled *Structure and Properties of Alloys*), (1977).

Brick et al., *Structure and Properties of Engineering Materials*, Iron and Steel Alloys: Low–Carbon Steels (1977) pp. 273–278.

Carpenter Technology Corporation, Alloy Data Sheets (1991).

Cubberly et al., *Properties and Selection: Stainless Steels, Tool Materials and Special Purpose Metals*, Metal Handbook Ninth Edition, vol. 3, (1980) pp. 615–632.

Kinzel et al., *Special Low–Chromium Steels*, The Alloys of Iron and Chromium, vol. 1 (1937), pp. 406–414.

McCraig, M., *Permanent Magnets in Theory and Practice,* Permanent Magnet Materials, (1977), pp. 84–87, 352–353.

(List continued on next page.)

*Primary Examiner*—George Wyszomierski
*Attorney, Agent, or Firm*—James D. Dee, Esq.

[57] ABSTRACT

Methods for preparing magnetic strips are provided in which the strips are manufactured to a thickness of less than about 0.005 inches and are made of a ferrous alloy having a carbon content of from about 0.4 to about 1.2 weight percent. The strips can be prepared by first manufacturing an alloy having a carbon content below about 0.5 weight percent to the desired thickness and then subjecting the strip to a carburizing step to raise the carbon content in the strip. The strips can also be prepared by controlling the chemistry of the initial alloy and controlling the processing of that alloy until the desired thickness and requisite magnetic properties are obtained. The strips are particularly useful in EAS systems.

12 Claims, 1 Drawing Sheet

OTHER PUBLICATIONS

Metals Handbook® Ninth Edition, vol. 4 Heat Treating, ASM Heat Treating Division Council, 1981.

New Engineering Opportunities in Specialty Metals, Carpenter Technology Corporation vol. 1, No. 6 (1990).

Standard Specification for Pressure Vessel Plates, Alloy Steel, Chromium–Molybdenum, Annual Book of ASTM Standards, (1991), pp. 257–259.

Takahashi et al., "Cr–Co Steels for Semi–Hard Magnets". Review of Electrical Communications Laboratories; vol. 21, 9–10 (1973), pp. 654–664.

Weymueller, C., Permanent Magnet Materials, Metal Progress, Jan. (1968), pp. 77–87.

ASTM Designation A 892–88 (Reapproved 1995) *Standard Guide for Defining and Rating the Microstructure of High Carbon Bearing Steels.*

MAGNETIC STRIPS AND METHODS FOR MAKING THE SAME

This is a division of application Ser. No. 08/394,705, filed Feb. 27, 1995, now U.S. Pat. No. 5,527,399 which is a continuation-in-part of application Ser. No. 114,439 filed Aug. 30, 1993, which issued on Jul. 11, 1995 as U.S. Pat. No. 5,431,746.

FIELD OF THE INVENTION

The present invention relates to permanent magnetic strips and processes for their preparation. More particularly the invention relates to relatively thin magnetic strips, those having a thickness of below about 0.005 inches. The strips are advantageously employed as components in markers or tags for use in electronic article surveillance (EAS) systems, and thus the present invention is related to improved magnetic markers and to methods, apparatus and systems for using such markers.

BACKGROUND OF THE INVENTION

Certain metallic alloy compositions are known for their magnetic properties. Various applications exist for the use of such alloys within industry. The rapidly expanding use of such alloys has also extended into such markets as electronic article surveillance (EAS) systems. Many of these newer markets require alloys with superior magnetic properties at reduced costs such that the items within which they are employed can be discarded subsequent to their use.

EAS systems can be operated with markers as described in U.S. Pat. Nos. 4,510,489, 5,313,192, and 5,351,033, among others. These markers generally contain, as the operative control means within the marker itself, a semi-hard magnetic element and a soft magnetic element. The semi-hard magnetic element as described by the present invention is a component having a coercivity in the range of about 10–200 oersteds and a remanence, determined after the element is subjected to a DC magnetization field that magnetizes the element substantially to saturation, of about 7–13 kilogauss.

In the tag of the U.S. Pat. No. 4,510,489, a semi-hard magnetic element is placed adjacent to a magnetostrictive amorphous element. By magnetizing the semi-hard magnetic element substantially to saturation, the resultant remanence magnetic induction of the magnetic element arms or activates the magnetostrictive element so that it can mechanically resonate or vibrate at a predetermined frequency in response to an interrogating magnetic field.

The mechanical vibration results in the magnetostrictive element generating a magnetic field at the predetermined frequency. The generated field can then be sensed to detect the presence of the tag. By demagnetizing the semi-hard magnetic element, the magnetostrictive element is disarmed or deactivated so that it can no longer mechanically resonate in response to the applied field.

The metallic alloy compositions that constitute permanent magnets are characterized by various performance properties such as coercive level, $H_c$, and residual induction, $B_r$. The coercive level is a measure of the resistance of the magnet to demagnetization and the residual induction is a measure of the level of induction possessed by a magnet after saturation and removal of the magnetic field. Superior magnetic properties can be obtained by using a ferrous alloy containing chromium and cobalt. However, the presence of cobalt typically makes such alloys prohibitively expensive and thus impractical in various end uses, such as elements in markers used in EAS systems.

Certain of the newer magnetic markets further require the preparation of the alloy into a relatively thin strip of material such that the magnetic properties are provided in an economical fashion. As the demand for increasingly thin magnetic strips increases, the selection of metallic alloys possessing the required magnetic properties while also possessing the necessary machinability and workability characteristics to provide the desired shapes, becomes exceedingly difficult. For example, ferrous alloys having carbon contents of about 1 weight percent and chromium contents of about 3–5 weight percent have been shown to exhibit advantageous magnetic properties. However these alloys are mechanically hard and cannot be rolled easily to the required thickness due to either initial hardness or high levels of work hardening during processing.

A need therefore exists in the permanent magnet art, and particularly in the EAS systems art, for thin magnetic strips having superior magnetic properties without the need for cobalt and other expensive components in the alloy compositions constituting the magnetic strip. The magnetic strips should be made from alloy compositions which are amenable to processing of the alloy into the thin strips required by many industrial uses, especially those below about 0.005 inches in thickness.

SUMMARY OF THE INVENTION

The present invention provides methods for preparing magnetic strips and also magnetic strips that can be produced by those methods. The magnetic strips can be prepared having a thickness of less than about 0.005 inches, preferably less than about 0.003 inches, and more preferably less than about 0.002 inches. The magnetic strips can also be prepared without the need for cobalt in the alloy, while still providing superior magnetic properties, such that economical products result.

In accordance with a preferred embodiment, methods for preparing magnetic strips are set forth in which a ferrous alloy strip is provided containing iron and from 1 to about 15 weight percent chromium. The strip has a carbon content below about 0.5 weight percent and a thickness of less than about 0.005 inches. The strip is then heated at a temperature between about 750° C. and about 1200° C. in a carburizing atmosphere. The heating is continued for a period of time sufficient to raise the carbon content in the strip to between about 0.4 and about 1.2 weight percent.

The initial carbon content of the alloy used to provide the initial strip is selected to be such that the strip can be processed to the desired thickness. The carbon content of the initial strip is preferably below about 0.5 weight percent, preferably from about 0.05 to about 0.3 weight percent, and more preferably 0.1 to 0.25 weight percent. The strips having the selected, relatively low carbon content, are then processed to the desired thickness using conventional processing steps, such as rolling.

The manufacture of strips with the desired thickness having been achieved, the carbon content of the strip is then raised to provide the improved magnetic properties. This step is accomplished by subjecting the strip to a carburizing atmosphere. Preferred carburizing atmospheres are those containing methane as the carbon source, however methanol, ethanol, propanol, ethane, propane, butane, hexane, carbon monoxide and other sources of carbon can also be employed advantageously. Carrier gases such as hydrogen and nitrogen can be used in the carburization process. The carbon content of the strip is raised to a level of from about 0.4 to about 1.2, preferably from about 0.45 to about 1, and more preferably from 0.5 to 0.7, weight percent of the strip composition.

In accordance with a separate preferred embodiment, methods are set forth wherein the thin magnetic strips are prepared without the carburization process outlined above. In these methods, the final thin magnetic strip is prepared by controlling the chemistry of the starting ferrous alloy and controlling the processing conditions for cold rolling the alloy to below about 0.005 inches in thickness. It is preferred in the practice of these methods that the ferrous alloy be cold rolled while in a spheroidal annealed state to ensure the processability of the ferrous alloy that contains a requisite level of carbon to provide the desired final magnetic properties. The starting ferrous alloy contains between about 0.45 and 0.70 weight percent carbon and is subjected to cold rolling and subsequent annealing steps until reaching the desired thickness. The thin magnetic strip is then austenitized to dissolve the carbon and quenched to form a martensitic structure. This thin magnetic strip is then preferably tempered to provide the final magnetic properties: an intrinsic coercive level of at least about 35 or 40 oersteds and a residual induction of at least about 8,000 or 9,000 gauss.

The present invention also provides for the magnetic strips which can be produced by the methods set forth in the present invention. The present invention further provides for the use of the thin magnetic strips as elements in markers used in EAS systems, EAS systems using those markers, and the practice of EAS systems using those markers.

DETAILED DESCRIPTION OF PREFERRED EMBODIMENTS

Figure 1:
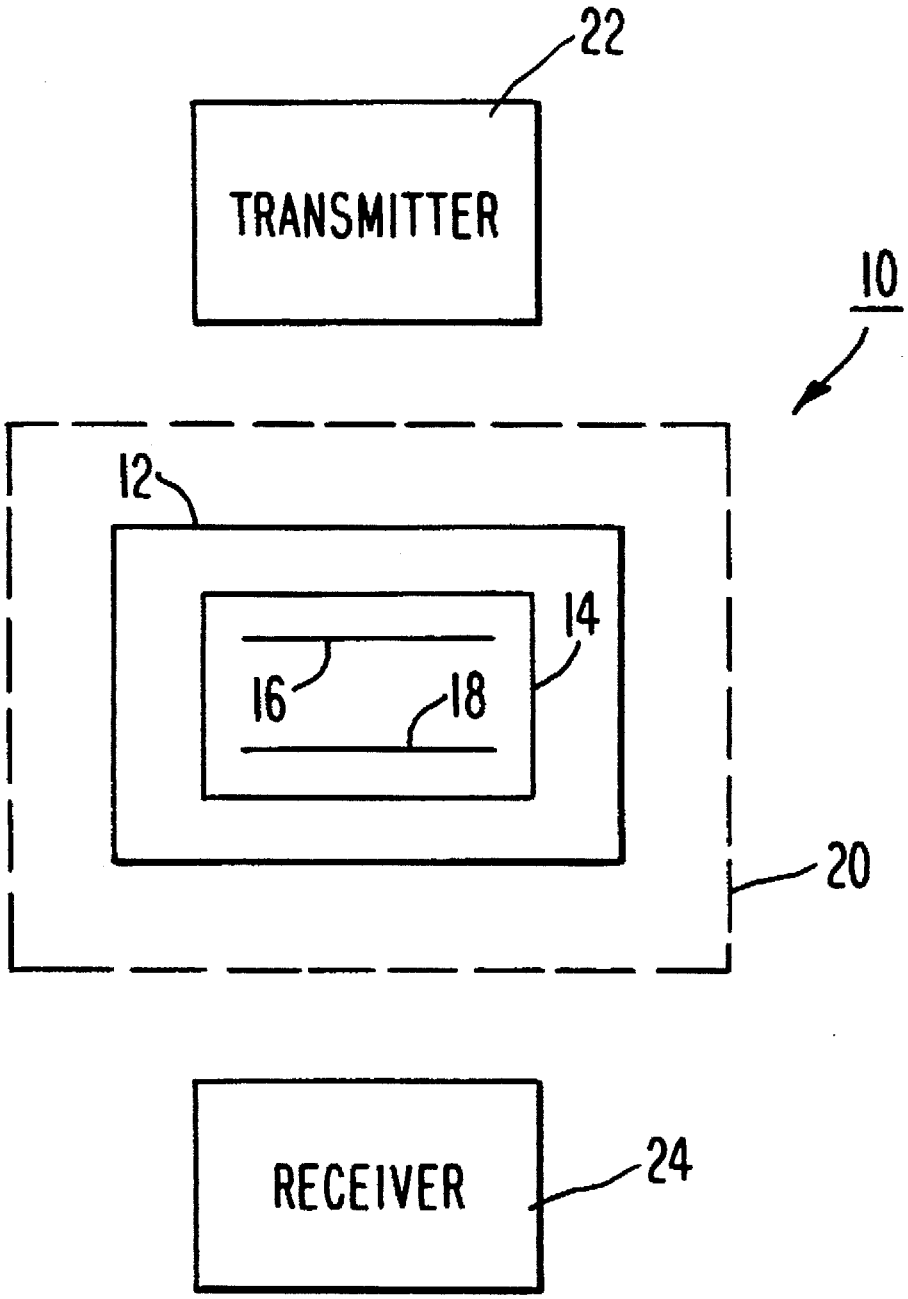
FIG. 1 is a representation of an EAS system using a marker including a semi-hard magnetic element as described in the present invention.

The present invention provides relatively thin magnetic strips of ferrous alloy materials and processes for preparing such magnetic strips. The thickness of the magnetic strips is less than about 0.005, preferably less than about 0.003, more preferably less than about 0.002, and in some cases in the range of from about 0.0005 to 0.002, inches.

Preparation of Thin Magnetic Strips by Carburization Techniques

Useful ferrous alloy compositions that possess the desired magnetic properties contemplated by this invention are those having a certain level of carbon. The carbon content for the final magnetic strip is advantageously from about 0.4 to about 1.2, preferably about 0.45 to about 1, and more preferably from 0.5 to 0.7, weight percent. It has been found, however, that a ferrous alloy having such a carbon content exhibits substantial work hardening upon rolling to the desired thickness of the strips contemplated by the present invention. Further, the size of the primary carbide phase present in a ferrous alloy having such a relatively high carbon content is believed to be a severe detriment to achieving the required strip thickness without structural flaws such as visibily observable holes, ridges, or tears. It is thus difficult to achieve strips having, at once, the desired thickness and high magnetic properties from a particular base alloy. The processes of the present invention provide magnetic strips having the desired thicknesses along with the desired carbon content with concomitant magnetic properties.

It has been found that the required thickness for the magnetic strip can be obtained in one embodiment by first rolling a ferrous alloy having a lower carbon content than that desired for the finished strip. The carbon content is then raised in the magnetic strip by a carburizing process to produce a final strip material having both the required thickness and the desired magnetic properties.

The ferrous alloy composition of the material employed to provide the initial magnetic strip having the required thickness is one containing up to about 0.5, preferably up to about 0.3, more preferably from about 0.05 to about 0.3, and even more preferably from 0.1 to 0.25, weight percent carbon. This alloy can further contain other elements useful to enhance the magnetic properties of the alloy such as chromium in an amount of from about 1 to about 15, preferably from about 2.5 to about 7, and more preferably from 3.5 to 5, weight percent. Molybdenum may also be present in an amount of up to about 4, preferably from 0.1 to about 2, and more preferably from 0.5 to 1, weight percent of the initial strip alloy. Vanadium may also be present in this strip alloy in an amount of up to about 1, preferably from about 0.05 to about 0.7, and more preferably from 0.1 to 0.5, weight percent. Other elements such as manganese in an amount of up to about 1.5, preferably from about 0.3 to about 1.2, and more preferably from 0.5 to 1, weight percent and silicon in an amount of up to about 1.5, preferably from about 0.3 to about 1, and more preferably from 0.5 to 1, weight percent may also be present in the initial strip alloy. Mixtures of the foregoing may be used and other compounds not interfering with the achievement of the objects of the invention may also be included.

The balance of the alloy that is used to manufacture the thin sheets of magnetic strip material is preferably composed essentially of iron except for the usual impurity elements found in commercial grades of iron alloys. The levels of these elements are preferably controlled to ensure that they do not detract significantly from the performance characteristics of the magnetic strip. In this regard, it is generally preferred to maintain the level of such elements as Ni below about 0.3 wt. %, Cu below about 0.2 wt. %, P and N below about 0.025 wt. %, O, S, Al, and H below about 0.015 wt. %.

One preferred alloy composition for conventional magnetic applications is an alloy having 0.15–0.22 wt. % C, 0.5–1.0 wt. % Mn, 3.5–4.5 wt. % Cr, 0.4–0.65 wt. % Mo, 0.5–1 wt. % Si, with the balance essentially iron. The level of such elements as S, P, Ti, Cu, Al, Ni, Co, W, V, Cb, H, O, and N is preferably maintained as low as possible, such as below 0.3 wt. % Ni, Co, and W; below 0.2 wt. % Cu, below 0.025 wt. % P and N, and below 0.015 wt. % for O, Ti, Al, S, Cb, and H.

The alloy compositions can also contain cobalt, although not preferred due to its expense, in an amount of below about 20, preferably from about 0.1 to about 10, percent by weight. The coercivity of the magnetic strips prepared from the base alloy can be improved by the incorporation of such elements as W, Ti, and Cb. The W can be present in an amount up to about 6 wt. %, preferably from about 0.1–4 wt. % of the alloy composition. The Ti can be present in an amount up to about 2 wt. %, preferably from about 0.1–1 wt. %, and the Cb can be present in an amount up to about 5 wt. %, preferably from about 0.1 to about 4 wt. % of the alloy composition.

The initial ferrous alloy composition is processed into the desired thickness forming the initial strip. Typically, the composition is processed into sheets or strips by conventional rolling techniques known to those of skill in the metal processing industry.

The magnetic strip, processed to its desired thickness, is then subjected to a carburization process. The overall carbon content of the magnetic strip alloy is thus raised to the level desired for a particular application. The final carbon content can be conveniently adjusted to produce a magnetic strip having the desired magnetic properties.

The carburization process can be conducted by any of the various methods known to those of skill in the art, such as gaseous and liquid carburization. Generally, using gaseous carburization, the low carbon magnetic strip is placed into a gaseous carburizing atmosphere at an elevated temperature for a time sufficient to raise the carbon content to the desired level. For example, a strip annealing furnace can be used as a means for providing a gaseous carburizing atmosphere to the low carbon ferrous alloy strip. The carburizing atmosphere is typically maintained at a temperature of from about 800° C. to about 1200° C., preferably from about 850° C. to about 1100° C. The preferred gaseous composition supplied to the carburizing atmosphere contains methane as a source of the carbon. The methane can be introduced along with a carrier gas, such as hydrogen or nitrogen, with the methane concentration being from about 5 to about 25 vol. %, preferably from about 10 to about 20 vol. %, and more preferably about 15 vol. %, all measured at standard temperature and pressure (STP) conditions. Various other gaseous compositions containing carbon can also be employed in the carburizing process such as ethane, propane, butane, hexane, methanol, ethanol, propanol, and carbon monoxide, and mixtures thereof. Carrier gases such as those known in the art, for example, carrier gas classes 201, 202, 302, and 402 can be utilized as set forth in Metals Handbook®, Ninth Edition, Vol. 4 (1981), American Society for Metals, pages 135–137, which is herein incorporated by reference.

The magnetic strips can be presented in the carburizing atmosphere in various configurations. It is preferred, however, that the upper and lower faces of the strip both be exposed to the carburizing atmosphere, preferably for the same amount of time, to ensure homogeneity of the carbon content within the cross-section of the strip. The duration of time that the magnetic strip is exposed to the carburizing atmosphere depends upon the geometry and the extent of carburization necessary, however typical residence times are below about 5 minutes, generally from about 1 to about 2 minutes.

The carbon content of the carburized magnetic strip is raised to a level of from about 0.4 to about 1.2, preferably from about 0.45 to about 1, and more preferably from 0.5 to 0.7, weight percent. This level of carbon content has been found to produce a thin magnetic strip having superior magnetic properties. The carbon content in the strip is generally raised by at least about 20, preferably by at least about 50, and more preferably from about 100 to about 1000, weight percent during the carburization process.

The magnetic properties of the strip can be further enhanced by conventional post carburization heat treatment. The preferred phase of the alloy is the martensite phase. This phase can be obtained, for example when the gaseous carburization process is employed, by subjecting the carburized alloy, generally in the austenite phase, to a quenching step following the carburization. This quenching step is generally accomplished by cooling the heated alloy from the elevated carburization temperature to about ambient, generally from 25°–35° C., in less than about 1 minute, preferably less than about 45 seconds, and more preferably less than about 30 seconds. This quenching step avoids the formation of undesired metallic phases. The strip can be further treated by a tempering process to stabilize the martensite and enhance its ductility. The tempering can be accomplished by heating the strip alloy to about 350°–425° C. for about 1–2 hours in an atmosphere such as argon with about 3–4% vol. (STP) hydrogen. Then, the strip alloy can be reaustenitized by subjecting the strip to temperatures of from about 870° C. to about 925° C. for a time sufficient to heat the alloy to that temperature, for example from about 0.1 to about 1 minute. The strip can be tempered an additional time at about 350°–425° C. for about 1–2 hours. The tempering process is useful to convert the retained austentite into the martensite phase and to reduce the brittleness of the alloy.

Preparation of Thin Magnetic Strips Without Carburization Techniques

It has been found pursuant to extensive research that a thin magnetic strip having the requisite high coercive level and residual induction can also be prepared without the need for a carburizing step. This achievement is made possible only through the discovery, made during the development associated with the carburization processing described above, that the requisite magnetic properties could be achieved through the use of structured processing techniques in conjunction with controlling the chemistry of the starting iron-based alloy. It was particularly found that a final carbon content of no more than about 0.7% wt., and preferably from about 0.45% wt. to about 0.65% wt., and more preferably from about 0.5% wt. to about 0.6% wt., preferably in combination with certain levels of chromium and molybdenum could, under proper manufacturing conditions, yield a thin strip material having suitable magnetic properties.

It has been found that superior magnetic properties of at least about 35 oersteds and at least about 8,000 or about 9,000 gauss can be achieved in a final, thin magnetic strip having a carbon content below about 0.7% wt., and preferably about 0.65% wt. or below, without resort to the manufacturing method of starting with a low carbon alloy and employing a carburization process to increase the final carbon content as detailed above. Although such a carburization processing technique can yield a final strip having the requisite magnetic properties, the use of a carburization step with a final strip thickness of below about 0.002 inches, and particularly below about 0.001 inches, can create problems with respect to the integrity of the strip. One such problem is that the strip is too fragile to withstand the thermal conditions encountered during the carburization process.

A final magnetic strip having the requisite thickness and magnetic properties can be prepared without resort to a carburization process by limiting the carbon content of the alloy to a level below where carbide formation substantially interferes with the cold rolling of the strip material and by controlling the form of the carbon during the rolling operation. Specifically, the alloy of the present invention is initially made into a billet or similar structure in accordance with conventional iron alloy technology. This material is generally hot worked in its high temperature austenitic phase down to a thickness of about 0.25 inches. The material is spheroidally annealed, that is, the material is heated and then cooled to form carbide particles in the ferrous alloy matrix, prior to being cold worked to its final thickness. The material is rolled down at a rate of about 40–70% reduction per pass with intermittent annealing steps to relieve built-up strain in the metal matrix. During the annealing steps, the material is not subjected to conditions that would create an austenite structure, and the annealing temperature is maintained below the austenitizing range. In such a way, the material is generally in its ferrite state with the carbon primarily found in spheroidal carbides within the iron-based matrix. The carbon is thus held within these spheroidal carbides within a "soft" ferrite matrix that can be cold rolled. It is preferred to control the size of the spheroidal carbides at or below the CS3, preferably at or below the CS2, and more preferably at or below the CS1, range as determined by the standard test procedure ASTM A892 so that the carbon can be effectively dissolved, into the iron-based matrix during the subsequent processing.

Following the cold rolling/annealing processing to achieve the final strip thickness, the strip is subjected to an austenitizing step. Thus, the strip is heated to its austenitizing temperature, generally to at least about 900° C., and advantageously to at least about 950° C., and then rapidly quenched to predominantly form the martensitic structure. The material is austenitized to dissolve the carbon from the carbide phase. The material is rapidly quenched to avoid the formation of a substantial amount of the ferrite and carbide phases, which do not provide sufficient final magnetic properties for the strip material. The rapid quenching to the martensitic phase provides superior magnetic properties. This austenite/martensite phase transition can be accomplished in a conventional strand type heat treating furnace with an adequate quenching zone. It is preferred that the material be cooled from the austenite temperature to below the martensitic starting temperature, generally about 200°–250° C., and preferably below about 30° C., in less than about 1.5 minutes, preferably less than about 1 minute, and more preferably less than about 45 seconds. This as-quenched material preferably has an intrinsic coercivity level of at least about 50, preferably at least about 55, and more preferably at least about 60, oersteds with a residual induction level of at least about 8000, preferably at least about 8500, and more preferably at least about 9000, gauss.

The rapid quenching operation may result in the presence of a retained austenite phase within the martensitic structure. This austenite phase impairs the residual induction performance properties of the strip. This quenched material is also in a metastable phase and can lose significant magnetic properties upon aging or physical shock. Therefore, a tempering step can then be conducted on the strip to condition the martensite into a more stable form and to relieve some of the strain in the martensitic structure allowing at least some of the retained austenite to transform into martensite. The extent of the tempering operation is dependent on the initial and desired final magnetic properties of the strip material; the tempering process results in an increase in the residual induction of the strip at the expense of coercivity performance. Thus, the conditions for the tempering operation, both the processing temperature and the time at the processing temperature, can be varied to properly tailor the final magnetic properties. It is preferred to conduct the tempering step within a strand type heat treating furnace and generally the strip is heated to between about 250° C. and 600° C. for at least about 5 seconds.

The alloys that can be processed into the thin magnetic strips of the present invention without the need of the carburization processing contain a carbon content of no more than about 0.7% wt., and preferably from about 0.45% wt. to about 0.65% wt., and more preferably from about 0.5% wt. to about 0.65% wt.; a chromium content of from about 3% wt. to about 6% wt., preferably from about 3.5% wt. to about 5% wt., and more preferably from about 3.5% wt. to about 4.5% wt.; and a molybdenum content of from about 0.1% wt. to about 2% wt., preferably from about 0.3% wt. to about 1.5% wt., and more preferably from about 0.4% wt. to about 1.25% wt. or to about 0.65% wt. The alloy can further have a manganese content of from about 0.2% wt. to about 2% wt., preferably from about 0.3% wt. to about 1.5% wt., and more preferably from about 0.5% wt. to about 1% wt.; a silicon content of from about 0.2% wt. to about 2% wt., preferably from about 0.3% wt. to about 1.5% wt., and more preferably from about 0.5% wt. to about 1% wt.; and a vanadium content of below about 1% wt., preferably from about 0.05% wt. to about 0.7% wt., and more preferably from about 0.1% wt. to about 0.5% wt. Mixtures of the foregoing may be used and other compounds not interfering with the achievement of the objects of the invention may also be included. The balance of the alloy is preferably composed essentially of iron except for the usual impurity elements found in commercial grades of iron alloys; thus the iron content is generally at least about 85% wt. and more preferably at least about 90% wt. The levels of the impurity elements should be controlled to ensure that they do not detract significantly from the performance characteristics of the magnetic strip. In this regard, it is generally preferred to maintain the level of such elements as Ni and W below about 0.3 wt. %, Cu below about 0.2 wt. %, P and N below about 0.025 wt. %, O, S, Al, Ti, and H below about 0.015 wt. %. The alloy is preferably prepared without an addition of cobalt due to its expense, although it can be added if desired. Thus, the alloy is essentially cobalt free and preferably contains cobalt only in an impurity level or rather a level that does not significantly effect the magnetic properties of the alloy. The cobalt content of the alloy is generally below about 5% wt., preferably below about 1% wt., and more preferably below about 0.5% wt.

The magnetic properties of the finished magnetic strip prepared by the processes set forth herein are such that it has typical coercive levels, $H_c$, of from about 20 to about 100 oersteds, the exact level being application specific. Preferred levels for $H_c$ for magnetic strips for such uses as in the electronic article surveillance field are from at least 35 to about 70 oersteds, more preferably from at least 40 to about 65 oersteds, and even more preferably from about 45 to about 60 oersteds. The residual induction, $B_r$, of the magnetic strip is typically from about 7000 to about 13,000 gauss, however in advantageous embodiments $B_r$ values of at least about 8,000 preferably at least about 9,000 and more preferably at least 10,000 gauss are desired. The magnetic properties of the thin strips of the present invention are readily determined using conventional testing equipment. The test equipment generally measures the coercive level and the flux of the material, and the flux is readily converted to a residual induction level by dividing the flux by the cross-sectional area of the test sample. An example of such equipment is the LDJ 7000T Loop Tracer available from LDJ, Inc., Troy, Mich. The flux of the thin magnetic strip material for certain applications is preferably at least about 65 maxwells and more preferably from about 65–85 maxwells.

The magnetic strips of the present invention are useful in such applications as protection devices in merchandise retailing. As such the thinness of the strips provides clear cost advantages to thicker strip materials. It is necessary, however, that the thin strips of the present invention can be slit into individual final products without breaking, thus the final strip material must not be too brittle. The ability to be readily slit is advantageously influenced by the post-martensite formation tempering procedures. The thin magnetic strips generally have a yield strength of at least about 115, preferably at least about 125, and more preferably at least about 140, ksi as determined by ASTM standard E-8.

The strips also generally have a tensile strength of at least about 125, preferably at least about 150, and more preferably at least about 175, ksi as determined by ASTM standard E-8, and a hardness of below about 65, preferably below about 60, and more preferably below about 58, $R_c$ as determined by ASTM standard E-92.

The magnetic strips of the present invention are particularly suited for use as control elements for markers or tags in magnetic electronic article surveillance (EAS) systems. The preparation of such magnetic markers and their use in EAS control systems are well known in the art, and are shown, for example, in U.S. Pat. Nos. 4,510,489, 5,313,192, and 5,351,033, all of which are incorporated herein in their entirities. Generally, the EAS system operates as shown in FIG. 1, wherein an EAS system 10 is configured to have an article 12 in a detection zone 20. A marker 14 is disposed on the article 12. The marker 14 has at least two elements for its operation—a semi-hard magnetic element 16 and a soft magnetic element 18. The semi-hard magnetic element 16 is constituted by the thin magnetic strip of the present invention. The soft magnetic element 18 is any of the various soft magnetic materials known by those skilled in the art to be useful in EAS markers, such as those materials set forth in U.S. Pat. Nos. 4,510,489 and 5,351,033. The soft magnetic material generally has a coercivity of less than about 5 oersteds, commonly less than about 2 oersteds, and more advantageously less than about 1 oersteds. Suitable materials include iron or cobalt alloys that contain various amounts of nickel, chromium, molybdenum, boron, phosphorus, silicon, carbon, and mixtures thereof; these alloys typically being amorphous. Typically, the semi-hard magnetic element 16 is used to activate and deactivate the marker 14.

The EAS system 10 generally further includes a transmitter 22 that transmits an AC magnetic field into the detection zone 20. The presence of the article 12, including the marker 14, in the zone 20 is detected by the receiver 24 that detects a signal generated by the interaction of the soft magnetic element 18 of the marker 14 with the transitted magnetic field.

By placing the semi-hard magnetic element 16 in a magnetized state, the soft magnetic element 18 of the marker 14 can be enabled and placed in an activated state so that it interacts with the applied field to generate a signal. By changing the magnetized state of the semi-hard magnetic element 16 to a demagnetized state, the soft magnetic element 18 is disabled and placed in a deactivated state so that the marker 14 will not interact with an applied magnetic field to generate a signal. In this way, the marker 14 can be activated and deactivated as desired within a conventional activation/deactivation system (not shown), as is well known in the art.

EXAMPLES

Example 1

A magnetic strip was prepared in accordance with the invention by processing a ferrous alloy having a carbon content of about 0.14 wt. % to the desired thickness of about 0.002 inches and then carburizing the strip to increase the carbon content to about 0.5 wt. %.

A 0.19 inch thick steel plate was rolled down to 0.002 inches by standard cold rolling techniques with process annealing as necessary. The alloy, designated as A3 alloy, had an elemental composition, on a weight basis, of: 4.4% Cr, 0.14% C, 0.52% Mo, 0.44% Mn, 0.27% Si, 0.13% Cu, 0.12% P, 0.006% S, 0.18% Ni, and 0.018% V, with the balance essentially iron. The strip was then passed through a horizontal strip annealing furnace with a 7 foot long hot zone maintained at about 1065° C. at a speed of about 5 ft/min., yielding a residence time of about 1.4 minutes in the hot zone. A gaseous mixture of 15% volume (STP) methane in hydrogen was fed into the carburizing zone of the furnace. The carbon content of the strip, now in the austentite form, exiting the furnace was about 0.5 wt. %.

The hot carburizing zone of the furnace was immediately followed by a quenching zone that transformed the alloy from the austentite to martensite phase, the desired magnetic phase. The quenching zone was operated at a temperature of about 30° C., the furnace being at that temperature within about a foot from the end of the hot zone, and the strip was cooled to that temperature within about 0.2 minutes.

The strip was then tempered in a batch furnace for about 1.5 hours at a temperature of 400° C. in an atmosphere containing argon with 3.8% vol. (STP) hydrogen. The strip was then cooled and reaustenitized by running the strip through the strip annealing furnace again, with the temperature in the hot zone maintained at about 900° C., at a rate of 35 ft./min. in a hydrogen atmosphere. The residence time was about 0.2 minutes at the elevated temperature. The strip was again tempered for 1.5 hours at 400° C. in the argon/3.8% hydrogen atmosphere.

The strip had a coercive level, $H_c$, of about 45 oersteds and a residual induction, $B_r$, of about 10,400 gauss.

Example 2

A second magnetic strip was prepared from an alloy designated as A2 alloy having a weight composition of 13.3% Cr, 0.32% C, 0.66% Mn, 0.66% Si, 0.008% Al, 0.012% P, 0.001% S, and 0.003% Sn. The material was rolled down to 0.002" and cut into suitably sized pieces. The material was then loaded into a tube furnace and heated in hydrogen. When the temperature reached 1750° F., an atmosphere of hydrogen and 5% methane was introduced for 10 minutes, then flushed with argon and quenched. The resulting carbon concentration in the strip was between 0.56 and 0.60 weight percent. The A2 alloy was also treated in the same way but without the methane addition for control purposes. The two sets of strips were then tempered at different temperatures and the magnetic characteristics compared as shown in Table I below.

The A3 alloy of Example 1 was processed according to the procedures set forth in Example 1 with the residence time in the carburizing atmosphere and the tempering conditions varied. The residence time was decreased for one set of strip components to yield strips having a carbon content of about 0.25–0.27 wt. % as controls and the residence time was increased to yield strips having a carbon content of about 0.69 wt. % for examples representative of the present invention. These two sets of strips were then tempered at different temperatures and the magnetic characteristics compared as shown in Table I below.

The coercivities of the carburized strips were found to be higher than the uncarburized ones. The remanences of the carburized strips, however, were found to be generally less than the uncarburized strips.

| Alloy | Carbon content (wt. %) | Coercivity (Hc, in Oe) | Remanance (Br, in KG) | Thickness (inches) | Tempering Conditions |
|---|---|---|---|---|---|
| A3 | 0.256 | 31 | 6.6 | 0.0018 | Not Tempered |
| A3 | 0.698 | 34–36 | 5.7–6.0 | 0.0018 | |
| A3 | 0.272 | 29–30 | 6.3–6.4 | 0.0016 | Not Tempered |
| A3 | 0.6995 | 33–34 | 4.5–4.7 | 0.0016 | |
| A3 | 0.256 | 21–22 | 6.6 | 0.0018 | Tempered at |
| A3 | 0.6998 | 38 | 6.5–7.1 | 0.0018 | 400° C. |
| A3 | 0.272 | 21–22 | 6.5 | 0.0016 | Tempered at |
| A3 | 0.6995 | 38 | 6.0–6.2 | 0.0016 | 400° C. |
| A2 | 0.35 | 65 | 6.8 | 0.002 | Not Tempered |
| A2 | 0.60 | 80 | 6.4 | 0.002 | |
| A2 | 0.35 | 60 | 7.2 | 0.002 | Tempered at |
| A2 | 0.60 | 81 | 6.3 | 0.002 | 200° C. |
| A2 | 0.35 | 60 | 7.2 | 0.002 | Tempered at |
| A2 | 0.60 | 78 | 7.0 | 0.002 | 315° C. |
| A2 | 0.35 | 62 | 7.3 | 0.002 | Tempered at |
| A2 | 0.60 | 73 | 7.2 | 0.002 | 370° C. |
| A2 | 0.35 | 58 | 7.6 | 0.002 | Tempered at |
| A2 | 0.60 | 72 | 7.1 | 0.002 | 425° C. |
| A2 | 0.35 | 50 | 7.6 | 0.002 | Tempered at |
| A2 | 0.60 | 65 | 7.4 | 0.002 | 480° C. |
| A2 | 0.35 | 15 | 7.8 | 0.002 | Tempered at |
| A2 | 0.60 | 65 | 7.4 | 0.002 | 540° C. |

Example 3

A thin magnetic strip was prepared without the need for a carburization step by the following process. A ferrous alloy strip having a thickness of 0.006 inches and 13 inches wide was recieved from a commercial manufacturer. The strip contained 0.58% wt. C, 4.03% wt. Cr, 0.51% wt. Mo, 0.01% wt. V, 0.68% wt. Mn, 0.53% wt. Si, and the balance essentially iron. The strip edges were trimmed. The as-received strip was previously spheroidally annealed and had spheroidal carbides of about CS3.

The strip was rolled on a Sendzimir mill to about 0.002 inches in two passes at strip speeds of about 300 feet per minute. The strip was then austenitized and quenched in a strip annealing furnace with an in-line scrubber before the furnace. The seven foot long hot zone of the furnace was held at 950° C. and the strip speed was about 25 feet per minute. The quench rate of the cooling zone was sufficient to reduce the temperature of the strip to room temperature, about 25° C., within one minute. An in-line magnetic tester was used to determine that the strip had an intrinsic coercive level, coercivity, of about 52–55 oersteds, and a residual induction, remanence, of 9100 gauss.

The strip was then tempered in the same furnace at at temperature of about 400° C. and a strip speed of about 40 feet per minute. The final magnetic properties of the strip were about 49 oersteds and 9800 gauss.

The procedure used to determine the magnetic properties of the strip was to obtain a sample—about 3 inches long, 0.5 inches wide, and about 0.002 inches thick—and analyze the samples in an appropriate piece of test equipment used to determine magnetic properties, in this case a tester similar to an LDJ 7000T tester. The test equipment displayed the second quadrant of the hysteresis loop on an oscilloscope screen. The coercivity and flux were determined, and the flux was used to calculate the remanence.

What is claimed is:

1. A thin magnetic strip that is readily slit and that exhibits superior magnetic properties, comprising a ferrous alloy strip having a thickness of between about 0.0005 and 0.003 inches, said strip consisting essentially of at least about 85 weight percent iron, from about 0.45 to about 0.7 weight percent carbon, from about 3 to about 6 weight percent chromium, from about 0.1 to about 2 weight percent molybdenum, and optionally from about 0.05 to about 1 weight percent vanadium, from about 0.2 to about 2 weight percent manganese, and from about 0.2 to about 2 weight percent silicon, said strip having a coercive level of at least 40 oersteds, a residual induction of at least 7,000 gauss, and a flux of at least about 65 maxwells.

2. The thin magnetic strip of claim 1 wherein the strip comprises from about 3.5 to about 5 weight percent chromium and from 0.3 to about 1.5 weight percent molybdenum.

3. The thin magnetic strip of claim 2 wherein the thickness of the strip is less than 0.002 inches.

4. The thin magnetic strip of claim 1 wherein the residual induction is at least 9,000 gauss.

5. The thin magnetic strip of claim 4 wherein the coercive level is at least about 45 oersteds.

6. The thin magnetic strip of claim 5 wherein the strip comprises from about 3.5 to about 5 weight percent chromium and from 0.3 to about 1.5 weight percent molybdenum.

7. The thin magnetic strip of claim 6 wherein the strip is essentially free of cobalt.

8. The thin magnetic strip of claim 6 wherein the thickness of the strip is less than 0.002 inches.

9. A marker for use in an electronic article surveillance system, comprising:

(a) a semi-hard magnetic element comprising a ferrous alloy strip having a thickness of between 0.0005 and 0.003 inches, said strip consisting essentially of at least about 85 weight percent iron, from about 0.45 to about 0.7 weight percent carbon, from about 3 to about 6 weight percent chromium, from about 0.1 to about 2 weight percent molybdenum, and optionally from about 0.05 to about 1 weight percent vanadium, from about 0.2 to about 2 weight percent manganese, and from about 0.2 to about 2 weight percent silicon, said strip having a coercive level of at least 40 oersteds, a residual induction of at least 7,000 gauss, and a flux of at least about 65 maxwells; and (b) a soft magnetic element disposed adjacent to said semi-hard magnetic element.

10. The marker of claim 9 wherein said ferrous alloy strip has a residual induction of at least 9,000 gauss.

11. The marker of claim 10 wherein said ferrous alloy strip is essentially free of cobalt.

12. An electronic article surveillance system for detecting the presence of a tag in a detection zone comprising:

(a) a marker comprising:

(i) a semi-hard magnetic element comprising a ferrous alloy strip having a thickness of between 0.0005 and 0.003 inches, said strip consisting essentially of at least about 85 weight percent iron, from about 0.45 to about 0.7 weight percent carbon, from about 3 to about 6 weight percent chromium, from about 0.1 to about 2 weight percent molybdenum, and optionally from about 0.05 to about 1 weight percent vanadium, from about 0.2 to about 2 weight percent manganese, and from about 0.2 to about 2 weight percent silicon, said strip having a coercive level of at least 40 oersteds, a residual induction of at least 7,000 gauss, and a flux of at least about 65 maxwells;

(ii) a soft magnetic element disposed adjacent to said semi-hard magnetic element; and (b) means for detecting the presence of said marker in said detection zone.

* * * * *